US011306954B2

(12) United States Patent
Arensmeier et al.

(10) Patent No.: US 11,306,954 B2
(45) Date of Patent: Apr. 19, 2022

(54) SYSTEM FOR FLUID PUMP DOWN USING VALVES

(71) Applicant: Emerson Electric Co., St. Louis, MO (US)

(72) Inventors: Jeffrey N. Arensmeier, Fenton, MO (US); Jacob Harris, St. Louis, MO (US); Thomas P. Buescher, Webster Groves, MO (US); John M. Bronson, St. Louis, MO (US); Gregory E. Sisk, Bonne Terre, MO (US); Christina M. Gillam, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 190 days.

(21) Appl. No.: 16/790,228

(22) Filed: Feb. 13, 2020

(65) Prior Publication Data

US 2021/0254875 A1 Aug. 19, 2021

(51) Int. Cl.
*F25B 45/00* (2006.01)
*F25B 41/20* (2021.01)

(52) U.S. Cl.
CPC ..... *F25B 45/00* (2013.01); *F25B 41/20* (2021.01); *F25B 2345/006* (2013.01); *F25B 2500/22* (2013.01); *F25B 2600/25* (2013.01)

(58) Field of Classification Search
CPC .... F25B 41/20; F25B 45/00; F25B 2345/006; F25B 2500/22; F25B 2600/25
USPC ..... 137/630.16, 630.17
See application file for complete search history.

(56) References Cited

U.S. PATENT DOCUMENTS

| | | | | |
|---|---|---|---|---|
| 3,237,642 | A | 3/1966 | Tomson | |
| 4,365,659 | A * | 12/1982 | Yoshida | B60C 1/0008 152/510 |
| 5,277,032 | A * | 1/1994 | See | F25B 45/00 62/125 |
| 5,437,304 | A * | 8/1995 | Delcroix | B29C 33/04 137/595 |
| 5,915,402 | A | 6/1999 | Mitchell, II | |
| 6,197,195 | B1 * | 3/2001 | Booth | B01D 29/35 210/340 |
| 6,338,255 | B1 | 1/2002 | Richard et al. | |
| 6,843,070 | B1 | 1/2005 | Suharno | |
| 8,001,783 | B2 * | 8/2011 | Dale | F02B 37/004 60/612 |
| 9,366,347 | B2 | 6/2016 | Diehl et al. | |
| 10,344,883 | B2 * | 7/2019 | Brazas | F01P 7/14 |
| 2005/0252556 | A1 * | 11/2005 | Williams | F15B 11/006 137/596.17 |

(Continued)

*Primary Examiner* — Jonathan Bradford
(74) *Attorney, Agent, or Firm* — Armstrong Teasdale LLP

(57) ABSTRACT

A valve system includes a motor, a first valve, a second valve, and a controller. The first valve is connected to the motor shaft and is rotatable to an open position, in which fluid flows through a first channel, and a close position, in which fluid is prevented from flowing through the first channel. The second valve is connected to the motor shaft and is rotatable to an open position, in which fluid flows through a second channel from a first end to a second end, and to a close position, in which fluid is prevented from flowing through the second channel. The controller is connected to the motor and can sequentially actuate the first valve and the second valve to create at least a first, second, third, and fourth position.

20 Claims, 7 Drawing Sheets

(56) References Cited

U.S. PATENT DOCUMENTS

| | | | | |
|---|---|---|---|---|
| 2019/0186769 | A1 | 6/2019 | Zimmermann | |
| 2019/0353260 | A1* | 11/2019 | Jenks | F16K 31/055 |
| 2020/0011580 | A1* | 1/2020 | Matsuda | F25B 13/00 |

* cited by examiner

SYSTEM FOR FLUID PUMP DOWN USING VALVES

FIELD

The field of the disclosure relates generally to fluid pump down using valves and, more particularly, to valve systems for removing refrigerant used in cooling systems from the interior of a structure.

BACKGROUND

Known heating, ventilation, and cooling (HVAC) systems and other cooling systems use refrigerants to remove heat from the conditioned space. In these systems, refrigerant flows from an outdoor condensing unit through a liquid line into an interior space, such as a residence. The liquid refrigerant boils while absorbing heat to be removed from the conditioned space, thereby cooling blowing air before the refrigerant is returned to a compressor in the outdoor condensing unit using a suction line. Many of these known HVAC systems use chlorofluorocarbons (CFCs), hydrochlorofluorocarbons (HCFCs), and/or hydrofluorocarbons (HFCs) and other similar, relatively inert compounds as refrigerants. Advantageously, such refrigerants are non-flammable, meaning that the refrigerants are relatively safe while they are pumped through residences and other facilities. As such, between cycles of the HVAC system, residual refrigerant may be left in interior portions of the HVAC system and pose little risk to the structure. Typically, these systems include manually operated service valves, which facilitate shipping and service of the system by isolating the condensing unit from the home side of the system when closed. Additionally, such systems using non-flammable refrigerants can be easily serviced using common Schrader valves or other similar valves to monitor pressure and add or remove the refrigerants from the system.

However, CFCs, HCFCs, HFCs and other similar compounds have a high Global Warming Potential ("GWP") or Ozone Depletion Potential ("ODP") and, as such, pose an environmental risk. Because of this high GWP potential, there has been a drive to use refrigerants having a lower GWP. Unfortunately, many such potential lower GWP refrigerants, such as difluoromethane, are flammable. In fact, many of the proposed low GWP refrigerants carry an American Society of Heating, Refrigerating and Air-Conditioning Engineers ("ASHRAE") designation of A2L, which indicates they are mildly flammable. Other low GWP refrigerants with higher flammability, carrying designations of A2 and A3, are also potential replacements for high GWP refrigerants. The flammability of these refrigerants poses a potential risk to the interior space if a quantity of A2L-designated or other flammable refrigerant above a critical volume is left within the interior space between cooling cycles of the HVAC system. For example, under some proposed U.S. regulations, a volume of A2L-designated refrigerant above 4 pounds (approximately 450 grams) within the interior space is considered dangerous to an average residential structure and requires additional mitigation to isolate the refrigerant from the environment as compared to non-flammable refrigerants.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure.

Accordingly, it should be understood that these statements are to be read in this light, and not as admissions of prior art.

BRIEF SUMMARY

In one aspect, a valve system includes a motor, a first valve, a second valve, and a controller. The motor has a shaft. The first valve is connected to the shaft and is rotatable to an open position, through which fluid flows to a first channel, and a close position, in which fluid is prevented from flowing through the first channel. The second valve is connected to the shaft and is rotatable to an open position, through which fluid flows to a second channel, and to a close position, in which fluid is prevented from flowing through the second channel. The controller is connected to the motor and is configured to, using the motor and the shaft, sequentially actuate the first valve and the second valve to create at least a first, second, third, and fourth position. In the first position, the first valve is in the closed position and the second valve is in the closed position. In the second position, the first valve is in the open position. In the third position, the first valve is in the open position and the second valve is in the open position. In the fourth position, the first valve is in a closed position and the second valve is in the open position.

In another aspect, a cooling system includes an air handling unit, a condensing unit, a suction line, a liquid line, and a valve system. The air handling unit is configured to distribute air and includes an evaporator. The condensing unit includes compressor and a condenser. The compressor is fluidly connected to the condenser by a condenser line configured to channel refrigerant from the compressor to the condenser. The suction line is configured to channel refrigerant from the evaporator to the compressor. The liquid line is configured to channel refrigerant from the condenser to the evaporator. The valve system includes a motor, a liquid-line valve, a suction-line valve, and a controller. The motor has a shaft. The liquid-line valve is connected to the shaft and is in fluid communication with the liquid line. The liquid-line valve includes a liquid-line channel therethrough and the liquid-line valve is rotatable to an open position, in which refrigerant flows through the liquid-line channel, and to a closed position, in which refrigerant is prevented from flowing through the liquid-line channel. The suction-line valve is connected to the shaft and is in fluid communication with the suction line. The suction-line valve includes a suction-line channel therethrough and the suction-line valve rotatable to an open position, in which refrigerant flows, using suction, through the suction-line channel, and to a close position, in which refrigerant is prevented from flowing through the suction-line channel. The controller is connected to the motor and is configured to, using the motor and the shaft, sequentially actuate the liquid-line valve and the suction-line valve to create at least a first, second, third, and fourth position. In the first position, the liquid-line valve is in the closed position and the suction-line valve is in the closed position. In the second position, the liquid-line valve is in the open position. In the third position, the liquid-line valve is in the open position and the suction-line valve is in the open position. In the fourth position, the liquid-line valve is in a closed position and the suction-line valve is in the open position.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

Figure 1:
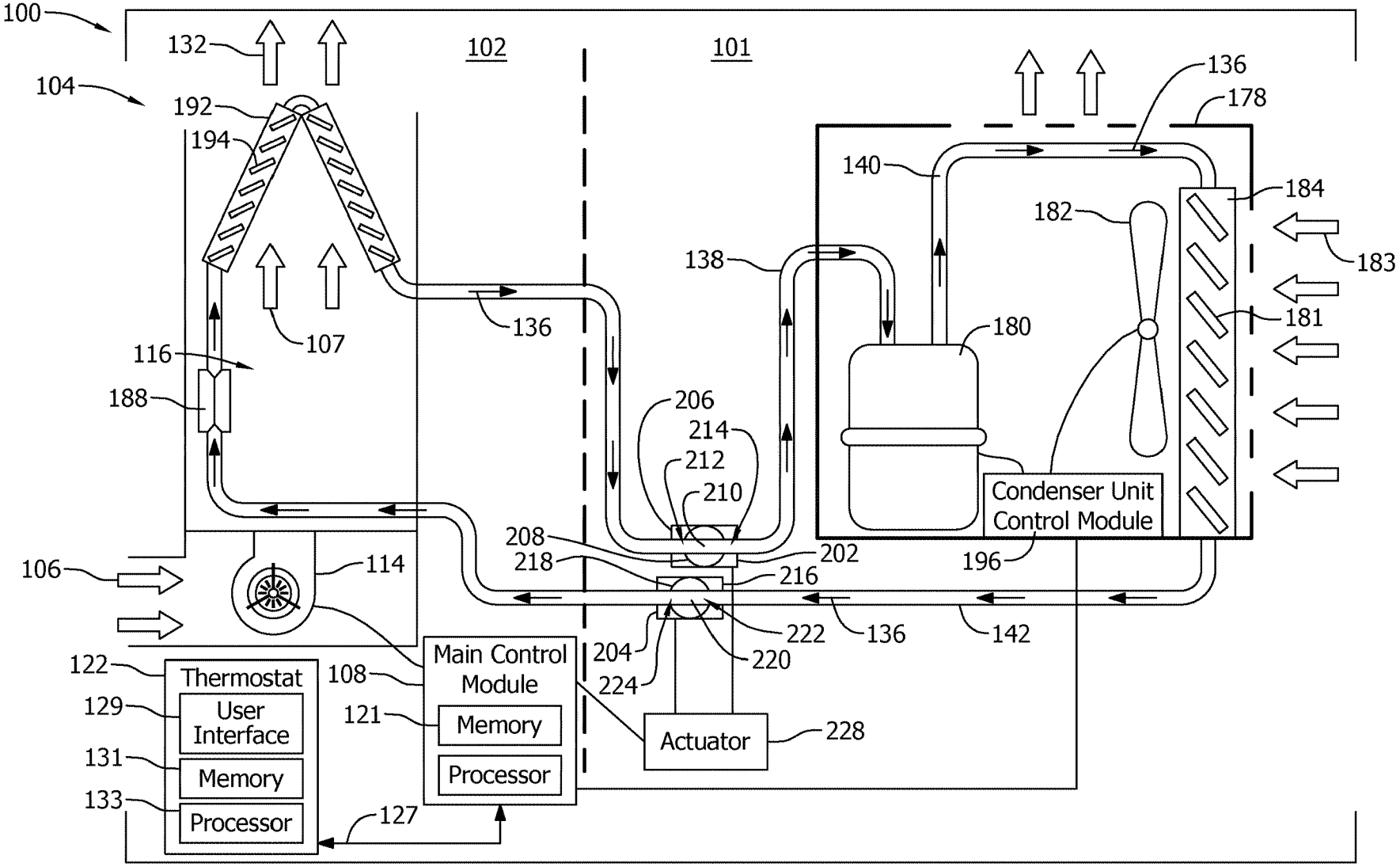
FIG. 1 is a block diagram of a heating, ventilation, and air conditioning (HVAC) system for a structure in accordance with an example embodiment of the present disclosure.

Corresponding reference characters indicate corresponding parts throughout the drawings. Although specific features of various embodiments may be shown in some drawings and not in others, this is for convenience only. Any feature of any drawing may be referenced and/or claimed in combination with any feature of any other drawing.

DETAILED DESCRIPTION

The following detailed description illustrates embodiments of the disclosure by way of example and not by way of limitation. It is contemplated that the disclosure has general application to cooling systems in which refrigerant is pumped between exterior and interior spaces, including industrial, commercial, and residential applications.

FIG. 1 is a block diagram of a heating, ventilation, and air conditioning (HVAC) system 100 for a structure 102 in accordance with an example embodiment of the present disclosure. In this example, a forced air system 104 is shown, though other systems are contemplated. Forced air system 104 includes a main control module 108, a blower 114, an air chamber 116, an expansion device 188, and an evaporator 192 including evaporator coils 194. Blower 114 is controlled by main control module 108. Main control module 108 includes one or more processors 119 and one or more memory devices 121. A thermostat 122 includes one or more processors 131 and one or more memory devices 133. Main control module 108 receives control signals 127 from thermostat 122. Thermostat 122 may include one or more temperature set points specified by a user through a user interface 129, which may be mounted on thermostat 122 or may be embodied in a mobile device, such as, but not limited to a smartphone.

In operation, return air 106 is pulled from structure 102 by blower 114 into plenum 116. Thermostat 122 may direct that blower 114 be turned on at all times or only when a cooling or heating request is present. Evaporator 192 is located within plenum 116 above blower 114. Evaporator 192 is placed in series with blown air 107 from blower 114 so that when cooling is desired, evaporator removes heat from blown air 107, thereby generating a cool supply air 132. It will be appreciated that HVAC system 100 may include heating components as well, such as a burner (not shown).

In an example, a split-type air conditioning system is shown including a condensing unit 178 located in an area 101 outside of structure 102. Condensing unit 178 includes a compressor 180, a fan 182, a condenser 184, and a condensing unit control module 196. Condensing unit control module 199 is operatively coupled to main control module 108 and is configured to control the operation of compressor 180 and fan 182. Compressor 180 is fluidly connected to evaporator 192 by means of a suction line 138. Compressor 180 is also fluidly connected to condenser 184 by means of a compressor discharge line 140. Condenser 184 is connected to evaporator 192 by means of liquid line 142. Expansion device 188 is coupled along liquid line 142 between condenser 184 and evaporator 192. Each of the suction line 138, compressor discharge line 140, and liquid line 142 are in fluid communication with one another such that refrigerant 136 cycles through each line 138, 140, 142 during a single cooling cycle of HVAC system 100.

Refrigerant 136 may be, for example, traditional, non-flammable HVAC refrigerants such as, for example, CFCs, HCFCs, HFCs, and the like. In alternative embodiments, refrigerant 136 may be mildly flammable, such as, for example, refrigerants with an ASHRAE designation of A2L, like difluoromethane and 1,3,3,3-tetrafluoropropene. In further embodiments, refrigerant 136 is any refrigerant that can be used with HVAC system 100 as described herein.

In an example operation of HVAC system 100, during the cooling of blown air 107, evaporator 192 is filled a low pressure, low temperature refrigerant 136 in the liquid form. As blown air 107 passes across the coils of evaporator 192, blown air 107 is cooled and refrigerant 136 within the coils is heated, generating a refrigerant 136 having a low temperature and low pressure in gas form. Refrigerant 136 is then drawn from evaporator 192 to compressor 180 within condensing unit 178 using suction line 138. During this process, refrigerant 136 is drawn from inside structure 102 to outside area 101. Compressor 180 rapidly compresses refrigerant 136, generating a high temperature, high pressure refrigerant 136. High temperature, high pressure refrigerant 136 in gas form is channeled through compressor discharge line 140 into condenser 184, where refrigerant 136 is channeled through a series of condenser coils 181. As refrigerant 136 travels through condenser coils 181, outside air 183 is drawn through the outside of the condenser coils 181 using fan 182, which cools and condenses the refrigerant 136. The medium temperature, high pressure liquid refrigerant 136 is then channeled through liquid line 142 back into structure 102 and to expansion device 188, causing refrigerant 136 to expand entering the evaporator 192 and lowering both the temperature and pressure of the liquid refrigerant 136. This low temperature, low pressure liquid refrigerant 136 is then channeled through evaporator to begin the air cooling process again. The above example operation of the cooling system of HVAC system 100 is described for illustrative purposes, but the phases of the refrigerant and the operation conditions of HVAC system 100 can vary according to a number of factors, such as the type of refrigerant used.

In this example, at least a portion of suction line 138 has a larger diameter than liquid line 142. More specifically, in an embodiment, suction line 138 is about ¾ inch to about 1 inch in diameter and liquid line 142 is about ¼ inch to about ½ inch in diameter. In further embodiments, suction line 138 us about ⅞ inch in diameter and liquid line 142 is about ⅜ inch in diameter.

HVAC system 100 includes a suction-line valve 202 located along suction line 138 between evaporator 192 and compressor 180. Suction-line valve 202 is configured to control the flow of refrigerant through suction line 138 and into compressor 180. In an embodiment, suction-line valve 202 is a ball valve having a suction-line valve body 206 and a suction-line valve ball 208 rotatable within suction-line valve body 206. Suction-line valve ball 208 has a first end 212, an opposing second end 214, and a suction-line valve channel 210 running between the two ends 212, 214. Suction channel 210 is configured to channel fluid from first end 212 to second end 214 when ball valve is in an open position. Specifically, in an embodiment, suction-line valve channel 210 is configured to channel refrigerant 136 through suction-line valve ball 208 when suction-line valve ball 208 is in an open position. Suction-line valve ball 208 is also configured to prevent the flow of refrigerant 136 through suction-line valve 202 when suction-line valve ball 208 is in a closed position (i.e. when suction-line valve ball 208 is rotated such that fluid cannot flow through suction-line valve channel 210; shown in FIG. 2).

HVAC system 100 also includes a liquid-line valve 204 located along liquid line 142 between condenser 184 and evaporator 192. Liquid-line valve 204 is configured to control the flow of refrigerant 136 through liquid line 142 to expansion device 188 and evaporator 192. In an example embodiment, liquid-line valve 204 is a ball valve having a liquid-line valve body 216 and a liquid-line valve ball 218 rotatable within liquid-line valve body 216. Liquid-line valve ball 218 has a first end 222, an opposing second end 224, and a liquid-line valve channel 220 running between the two ends 222, 224. Liquid-line valve channel 220 is configured to channel fluid from first end 222 to second end 224 when ball valve is in an open position. More specifically, liquid-line valve channel 220 is configured to channel refrigerant 136 through liquid-line valve ball 218 when liquid-line valve ball 218 is in an open position. Liquid-line valve ball 218 is also configured to prevent the flow of refrigerant 136 through liquid-line valve 204 when liquid-line valve ball 218 is in a closed position (i.e. when liquid-line valve ball 218 is rotated such that fluid cannot flow through liquid-line valve channel 220; shown in FIG. 2).

Suction-line valve 202 and liquid-line valve 204 are operatively coupled to an actuator 228 configured to actuate both valves 202, 204. Actuator 228 is also coupled to main control module 108. Main control module 108 controls the operation of actuator 228, which, in turn, controls the actuation of valves 202, 204. Specifically, actuator 228 is configured to rotate suction-line valve ball 208 and liquid-line valve ball 218 within their respective valve bodies 206, 216. Main control module 108 is configured to control the rotation of suction-line valve ball 208 and liquid-line valve ball 218 using actuator 228. In some embodiments, main control module 108 and/or actuator 228 may be configured to independently control the operation of suction-line valve 202 and liquid-line valve 204. Alternatively or in addition, in some embodiments, main control module 108 and/or actuator 228 may be configured to actuate both valves 202, 204 simultaneously.

Figure 2A:
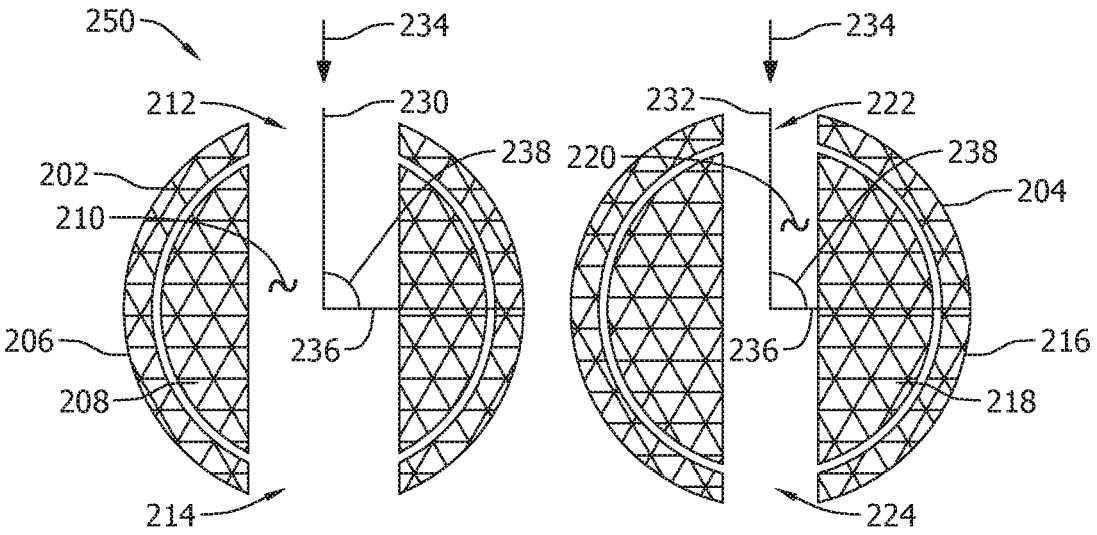
FIG. 2A is a schematic of an embodiment of a valve configuration for use with the HVAC system shown in FIG. 1.

FIG. 2*a* is a schematic diagram of an embodiment of suction-line valve ball 208 and liquid-line valve ball 218 in a first rotation configuration 250. As shown in FIG. 2*a*, suction-line valve ball 208 and liquid-line valve ball 218 may be the same size or may be substantially similarly size and may have the same or similar angular offset relative to suction-line valve body 206 and liquid-line valve body 216. More specifically, both suction-line valve 202 and liquid-line valve 204 have a direction of flow 234 for refrigerant 136, and an axis 236 transverse to direction of flow 234. Both a centerline 230 placed midway through suction-line valve channel 210 and a centerline 232 placed midway through liquid-line valve channel 220 have the same or substantially similar angular offset 238 relative to axis 236. In other words, suction-line valve ball 208 and liquid-line valve ball 218 are configured such that as both are actuated by actuator 228 and rotate within suction-line valve 202 and liquid-line valve 204, respectively, the angles between centerlines 230, 232 and axis 236 are the same or substantially similar.

Figure 2B:
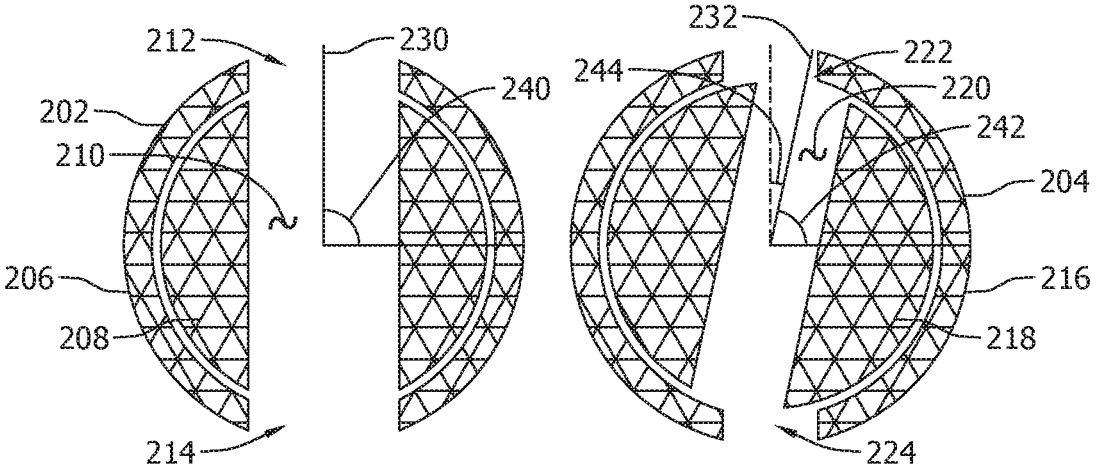
FIG. 2B is a schematic of an alternative embodiment of a valve configuration for use with the HVAC system shown in FIG. 1.

FIG. 2*b* is a schematic diagram of an alternative embodiment of suction-line valve ball 208 and liquid-line valve ball 218 in a second rotation configuration 252. Like in first rotation configuration 250, in second rotation configuration 252, suction-line valve ball 208 and liquid-line valve ball 218 may be the same size or may be substantially similarly size. Unlike in first rotation configuration 250, in second rotation configuration 252, suction-line valve ball 208 and liquid-line valve ball 218 have a different angular offset relative to suction-line valve body 206 and liquid-line valve body 216. More specifically, suction-line valve centerline 230 has a first angle 240 relative to axis 236 and liquid-line valve centerline 232 has a second angle 242 relative to axis 236, and second angle 242 is different from first angle 240. In an embodiment, an angular offset 244 between suction-line valve ball 208 and liquid-line valve ball 218 is greater than about 5 degrees and less than about 45 degrees. In further embodiments, angular offset 244 is greater than about 5 degrees and less than about 25 degrees. In alternative embodiments, angular offset 244 is any degree difference that allows HVAC system 100 to function as described herein.

In embodiments of first rotation configuration 250 and second rotation configuration 252, suction-line valve ball 208 and liquid-line valve ball 218 may be the same size or may be substantially similarly size. However, in some embodiments, suction-line valve channel 210 has a larger diameter than liquid-line valve channel 220. More specifically, in some embodiments, suction-line valve channel 210 has a diameter that is about the same or less than the diameter of suction line 138 and liquid-line valve channel 220 has a diameter that is about the same or less than the diameter of liquid line 142. In some embodiments, suction-line valve channel 210 is about ¾ inch to about 1 inch in diameter and liquid-line valve channel 220 is about ¼ inch to about ½ inch in diameter. In further embodiments, suction-line valve channel 210 is about ⅞ inch in diameter and liquid-line valve channel 220 is about ⅜ inch in diameter.

Figure 3:
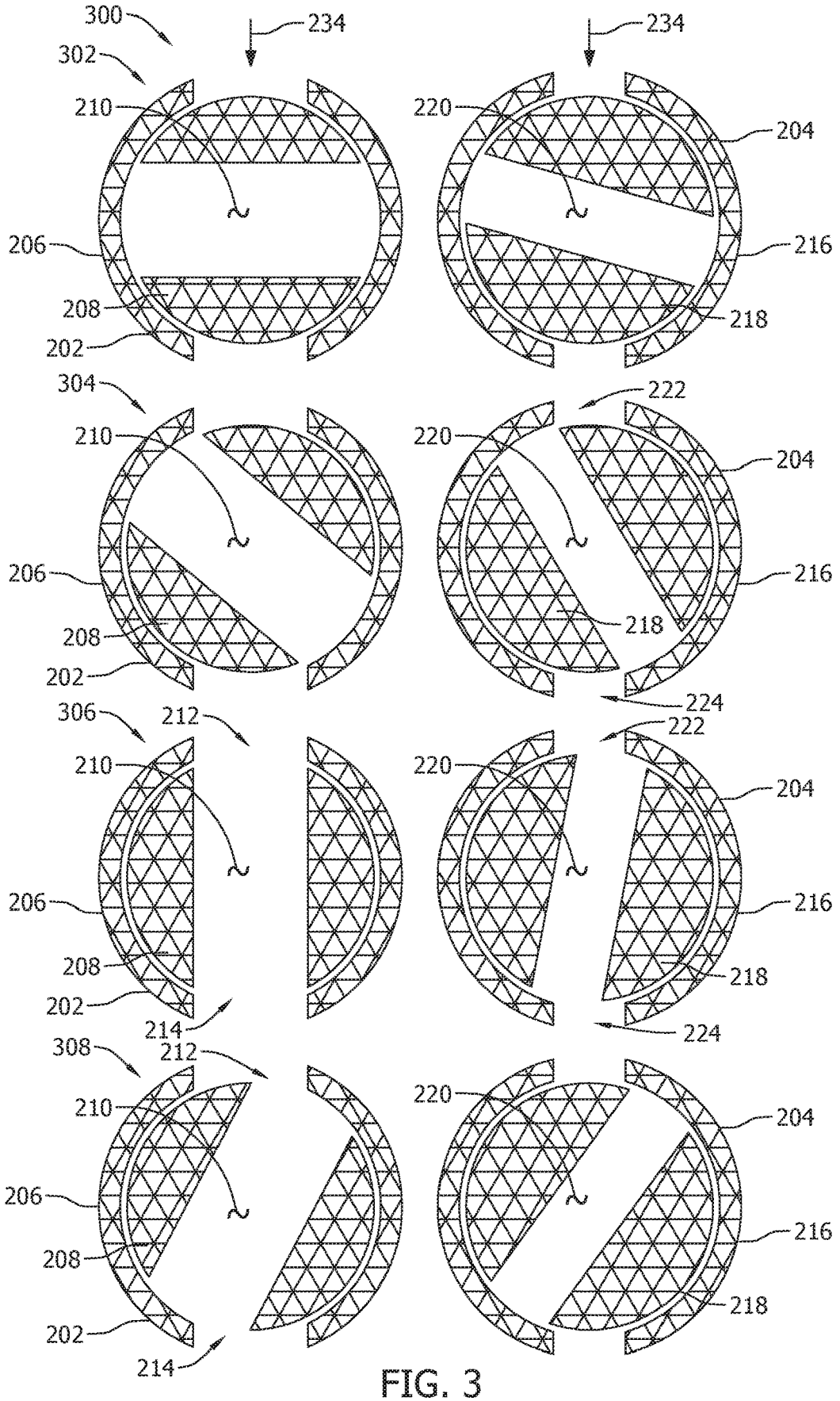
FIG. 3 is a schematic of an example rotation sequence for actuating valves for use with the HVAC system shown in FIG. 1.

FIG. 3 is a schematic diagram of an example rotation sequence 300 for actuating suction-line valve 202 and liquid-line valve 204. In rotation sequence 300, suction-line valve 202 and liquid-line valve 204 are configured relative to each other according to second rotation configuration 252.

In an embodiment, main control module 108 is configured to, by means of actuator 228 (shown in FIG. 1), sequentially actuate suction-line valve 202 and liquid-line valve 204. More specifically, main control module 108 is configured to actuate valves 202, 204 between four base positions 302, 304, 306, 308 to create on full rotation sequence 300.

In first position 302 of rotation sequence 300, both suction-line valve 202 and liquid-line valve 204 are in a closed position, preventing refrigerant 136 from flowing through channels 210, 220, respectively. More specifically, in first position 302, valve balls 208, 218 are rotated within valve bodies 206, 216 such that channels 210, 220 are open only to the sides of valve bodies 206, 216. In operation, while rotation sequence 300 is in first position 302, all or most of refrigerant 136 is contained between suction-line valve 202 and liquid-line valve 204 fluidly upstream of suction-line valve 202 and fluidly downstream of liquid-line valve 204. As such, in the first position, all, substantially all, or most of refrigerant 136 is located in outside area 101 and within condensing unit 178. Advantageously, in some embodiments, when rotation sequence 300 is in first position 302, flammable refrigerant 136 is removed from structure 102, decreasing the risks to structure 102.

In second position 304, suction-line valve 202 is in the closed position, preventing fluid from flowing therethrough, and liquid-line valve 204 is open, allowing refrigerant 136 to travel from first end 222 to second end 224 of liquid-line valve channel 220. Accordingly, in second position 304, refrigerant 136 begins to travel from condensing unit 178 in outside area 101 into structure 102. In other embodiments, both suction-line valve and liquid-line valve are in the open position in second position 304. In third position 306, both suction-line valve 202 and liquid-line valve 204 are in an open position, allowing refrigerant 136 to flow through channels 210, 220, respectively. Accordingly, in operation, when rotation sequence 300 is in second position 304 and third position 306, refrigerant 136 flows through liquid line 142 from condensing unit 178 to expansion device 188 and evaporator 192. In these two positions 304, 306, evaporator 192 cools blown air 107 to generate cool supply air 132.

In fourth position 308, suction-line valve 202 is open, allowing refrigerant 136 to flow from first end 212 to second end 214 of suction-line valve channel 210, while liquid-line valve 204 is closed, preventing refrigerant from traveling therethrough. In operation, in fourth position 308, refrigerant 136 is pumped down out of structure 102 and into condensing unit 178. In this example, most of the refrigerant 136 is removed from structure 101 while rotation sequence 300 is in fourth position 308. In other embodiments, 75% or more of refrigerant 136 is removed from structure 101 while rotation sequence 300 is in fourth position 308. In further embodiments, 90% or more of refrigerant 136 or, alternatively, substantially all of refrigerant 136 is removed from structure 101 while rotation sequence 300 is in fourth position 308.

After fourth position 308, rotation sequence 300 returns to first position 302. Operationally, returning to first position 302 means that most, 75% or more, 90% or more, or substantially all of refrigerant 136 is removed from structure 102 and moved to outside area 101 between suction-line valve 202 and liquid-line valve 204 fluidly upstream of suction-line valve 202 and fluidly downstream of liquid-line valve 204 and at least partially within condensing unit 178. Accordingly, one full rotation sequence 300 represents one cooling cycle of HVAC system 100 that includes one full pump-down procedure to remove most, 75% or more, 90% or more, or substantially all of the refrigerant from structure 102.

Suction-line valve 202 and liquid-line valve 204 are located in outside area 101 and outside of condensing unit 178 such that valves 202, 204 are accessible without entering condensing unit 178. With valves 202, 204 located outside of the condensing unit 178, a service technician can access valves 202, 204, and thus refrigerant 136, while refrigerant 136 is contained within condensing unit 178 between suction-line valve 202 and liquid-line valve 204 (i.e. when valves are in first position 302). Accordingly, a Schrader valve or other service valves are not required to service at least some embodiments of HVAC system 100. In alternative embodiments, valves 202, 204 are located within at least a portion of condensing unit 178. In some of these embodiments, valves 202, 204 are accessible within condensing unit 178 through a service access panel (not shown).

Valves 202, 204 are actuated in parallel, such that both valve balls 208, 218 rotate at substantially the same speed throughout one full rotation sequence 300. In alternative embodiments, valves 202, 204 may be actuated sequentially or their actuation may be offset. Further, channels 210, 220 may have alternative configurations, such as, for example, slots instead of round holes.

Figure 4:
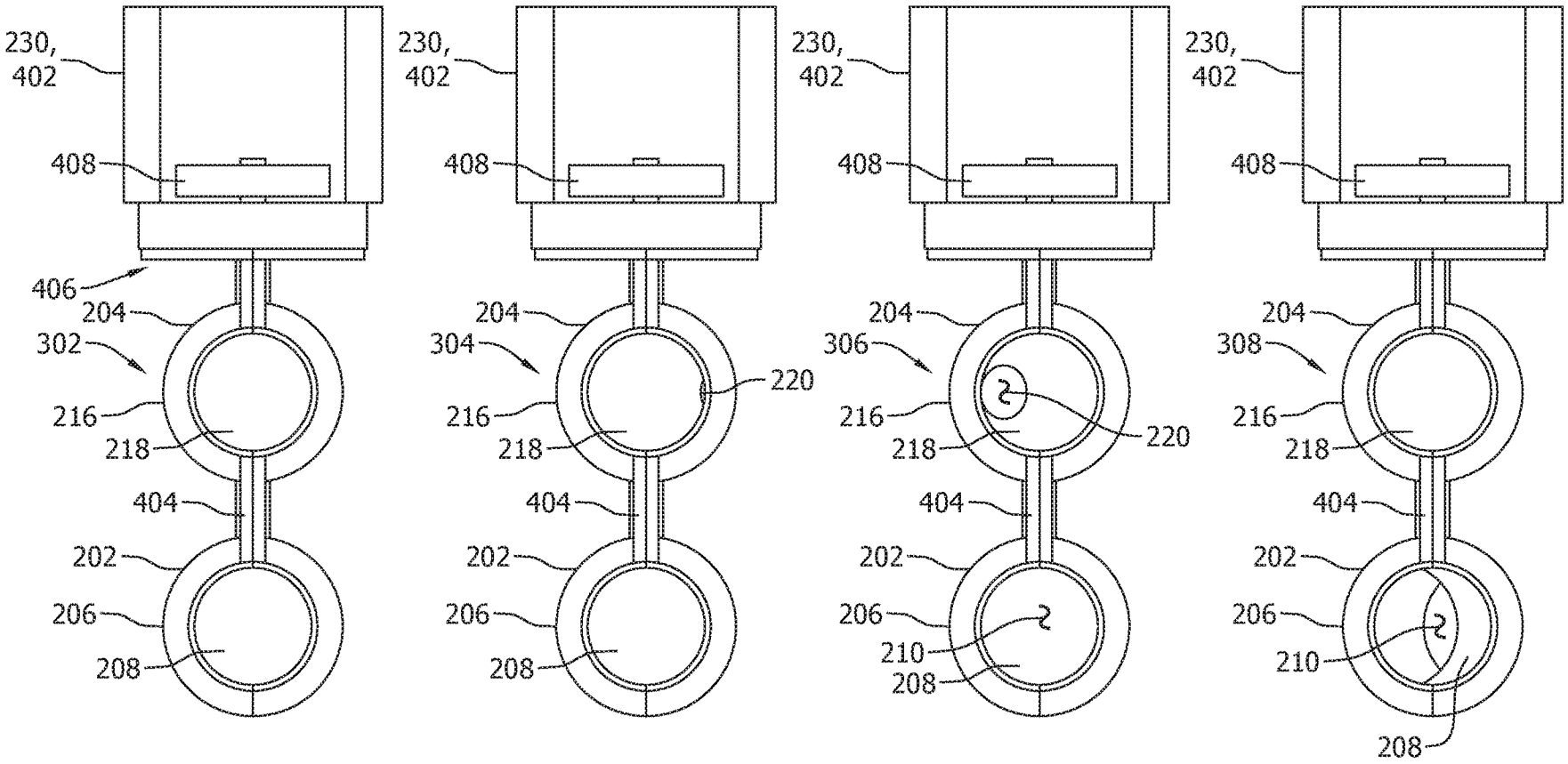
FIG. 4 is a schematic of a valve actuation system utilizing a motor and a shaft to the actuate valves for use with the HVAC system shown in FIG. 1.

FIG. 4 is a schematic view of a valve actuation system 400 utilizing a motor and a shaft to actuate valves 202, 204. In this embodiment, actuator 228 is a motor 402 having a shaft 404 coupled to a first end 406. Shaft 404 is operatively coupled to suction-line valve 202 and liquid-line valve 204 such that rotation of shaft 404 causes a corresponding rotation of suction-line valve ball 208 and liquid-line valve ball 218. In such a configuration, both valve balls 208, 218 rotate in unison. Accordingly, motor 402 is configured to rotate valves 202, 204 from first position 302 to second position 304 to third position 306 to fourth position 308 and back to first position 302.

Valve actuation system 400 may include a position sensor 408 configured to determine the angular position of suction-line valve ball 208 and liquid-line valve ball 218 within suction-line valve 202 and liquid-line valve 204, respectively. Position sensor 408 may be, for example, a rotary and/or angular encoder or a Hall-effect device. If position sensor 408 is an encoder, it may be a magnetic or optical encoder and it may be configured to provide either absolute or incremental output, or both. In other embodiments, position sensor 408 may be any sensor that allows for valve actuation system 400 to function as described herein. As illustrated, position sensor 408 is located on shaft 404 within motor 402. However, it will be appreciated that position sensor 408 may be located anywhere valve actuation system 400 that allows position sensor 408 to function as described herein.

In the illustrated embodiment and as described above, motor 402 is operatively coupled to main control module 108 and main control module 108 controls the operation of motor 402 and, by extension, shaft 404 and valves 202, 204. However, other configurations are contemplated within the scope of this disclosure. In some embodiments, motor 402 and/or valves 202, 204 may be operatively coupled to a separate controller (not shown) distinct from main control module 108. This separate controller may in turn be controlled by main control module 108 or may operate independent of main control module 108. For example, valves 202, 204 may be operatively coupled to a cam and switch system or other similar system configured to control the operation of valves 202, 204.

Figure 5:
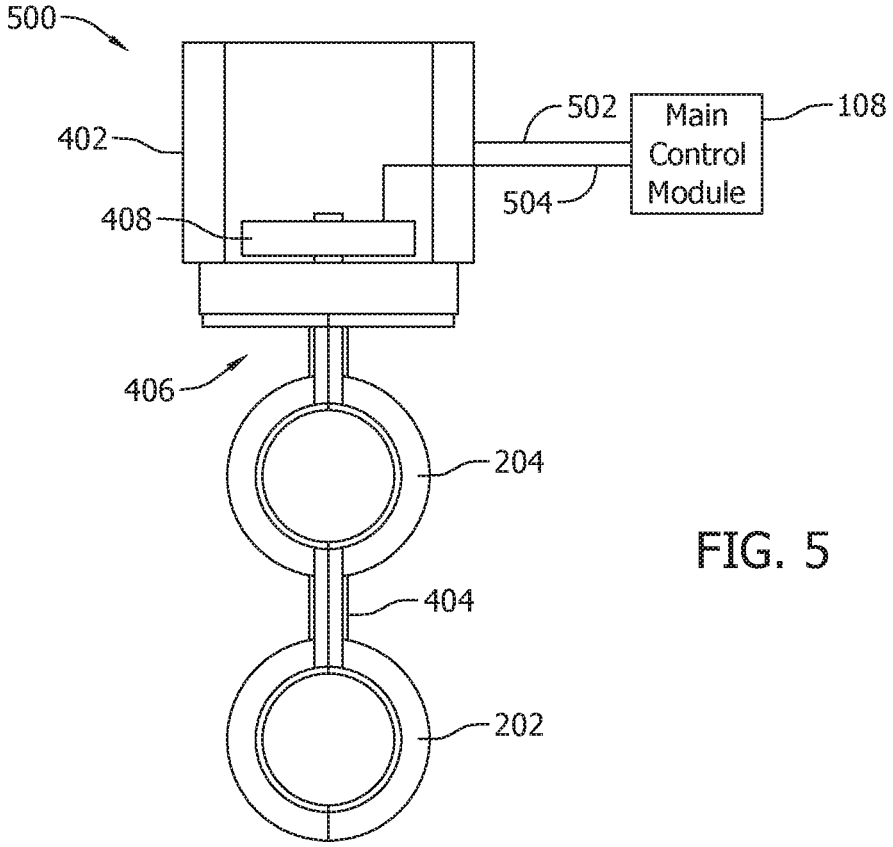
FIG. 5 is a schematic of an example valve operation system for use with the HVAC system shown in FIG. 1.

FIG. 5 is a schematic view of an example valve operation system 500. Similar to valve actuation system 400, in valve operation system 500, actuator 228 is a motor 402 having a shaft 404 coupled to a first end 406. Shaft 404 is operatively coupled to suction-line valve 202 and liquid-line valve 204 such that rotation of shaft 404 causes a corresponding rotation of suction-line valve ball 208 and liquid-line valve ball 218, rotating both valve balls 208, 218 in unison. In this example, valve operation system 500 also includes a position sensor 408.

A motor wire 502 operatively couples main control module 108 to motor 402. Main control module 108 is configured to control the operation of motor 402 and, by extension, actuation of valves 202, 204. In an embodiment, when thermostat 122 has a reading above a particular set point, thermostat 122 transmits a signal to main control module 108, which, in turn, activates motor 402 to begin actuating valves 202, 204 according to rotation sequence 300. The actuation of valves 202, 204 according to rotation sequence 300 causes refrigerant 136 to be pumped into structure 102 to cool air 107 before refrigerant 136 is pumped down from structure 102 back into condensing unit 137. The cycle is repeated as necessary to maintain the temperature at the thermostat 122 set point.

A sensor wire 504 operatively couples main control module 108 to motor position sensor 408. Sensor wire 504 enables position sensor 408 to transmit position information of shaft 404 to main control module 108. Based on the information received from position sensor 408, main control module 108 can change an operation of motor 402, such as, for example, increasing or decreasing the speed of motor 402. In some embodiments, the information from position sensor 408 can be used diagnostically in order to determine a defect in the actuation of valves 202, 204 and/or a defect in motor 402, such as wear or contamination in motor 402 or shaft 404. If a defect is detected, main control module 108 is configured to perform an additional operation, such as, for example, terminate operation of motor 402 or notify the operator of an error.

Motor 402 may be a direct current (DC) motor, a stepper motor, or an alternating current (AC) motor. Motor 402 may include position sensor 408. In some embodiments, the time between two positions of shaft 404 may be determined and the detected time difference compared to an expected value can indicate an error has occurred in valve operation system 500, such as wear or contamination in motor 402 or shaft 404. In embodiments where motor 402 is a stepper motor, main control module 108 may be configured to monitor the number of steps performed by motor 402 versus the position of shaft 404. Using the number of steps compared to the position, main control module 108 can detect errors that may occur. For example, if the number of steps recorded by control module 118 does not correspond to the expected position of shaft 404, the detected difference can indicate an error has occurred in valve operation system 500. If an error is detected based on readings from position sensor 408 and/or the number of steps, main control module 108 is configured to perform an additional operation such as, for example, terminate operation of motor 402 or notify the operator of an error.

Motor 402 may include a gear train, such as a simple or planetary gear train. In some embodiments, the gear train may provide additional torque to shaft 404, which in turn provides additional torque to suction-line valve 202 and liquid-line valve 204 in order to rotate suction-line valve ball 208 and liquid-line valve ball 218.

Figure 6:
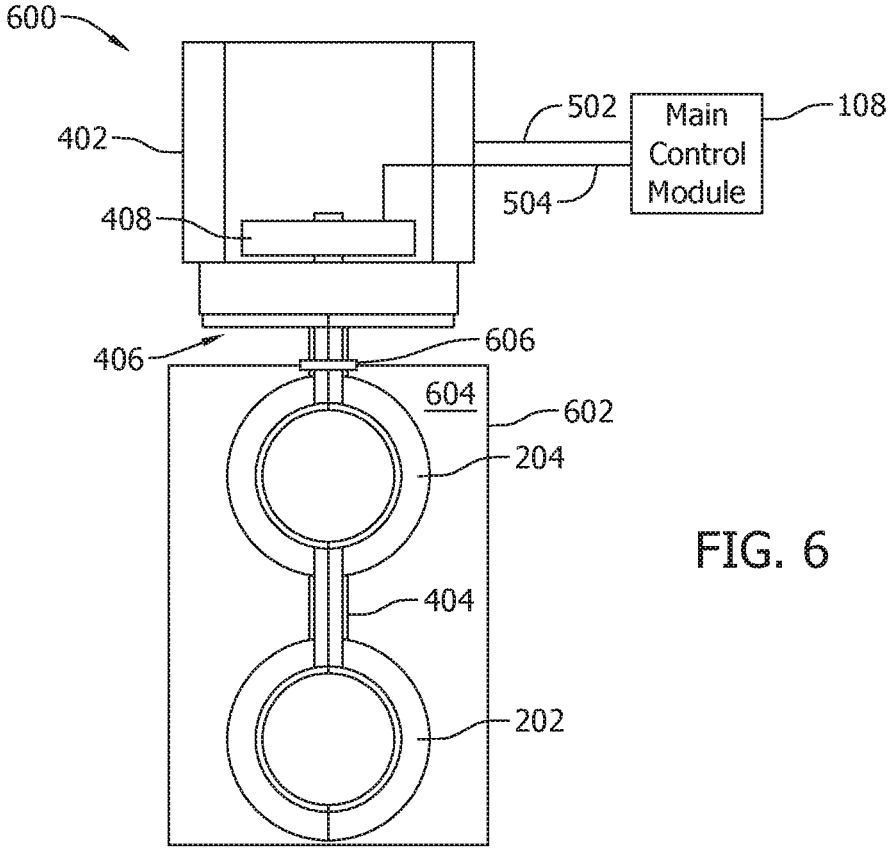
FIG. 6 is a schematic of an alternative valve operation system for use with the HVAC system shown in FIG. 1.

FIG. 6 is a schematic view of an example alternative valve operation system 600. Valve operation system 600 is similar to valve operation system 500. Valve operation system 600 includes an enclosure 602 surrounding suction-line valve 202 and liquid-line valve 204 such that both valves are within a cavity 604. In this embodiment, motor 402 is located outside of enclosure 602 with shaft 404 extending through enclosure 602 to valves 202, 204. Enclosure 602 is configured to contain any fluid, such as refrigerant 136, that may leak form valves 202, 204 during operation of valve operation system 600. In an embodiment, shaft 404 passes through a sealing body 606 within a wall of enclosure 602. Sealing body 606 helps isolate cavity 604 from outside are 101 and prevents leakage of fluid out of cavity 604 along shaft 404. In some embodiments, sealing body 606 includes a rubber or polymer ring.

Figure 7:
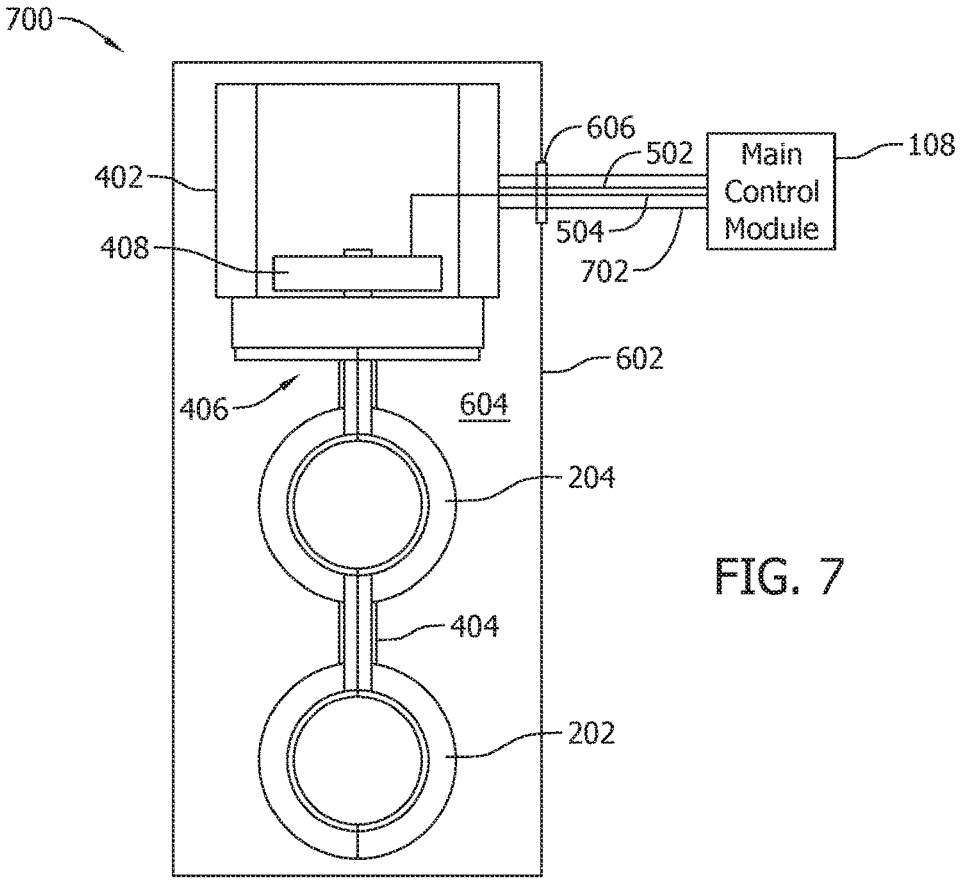
FIG. 7 is a schematic of an alternative valve operation system for use with the HVAC system shown in FIG. 1.
Figure 8:
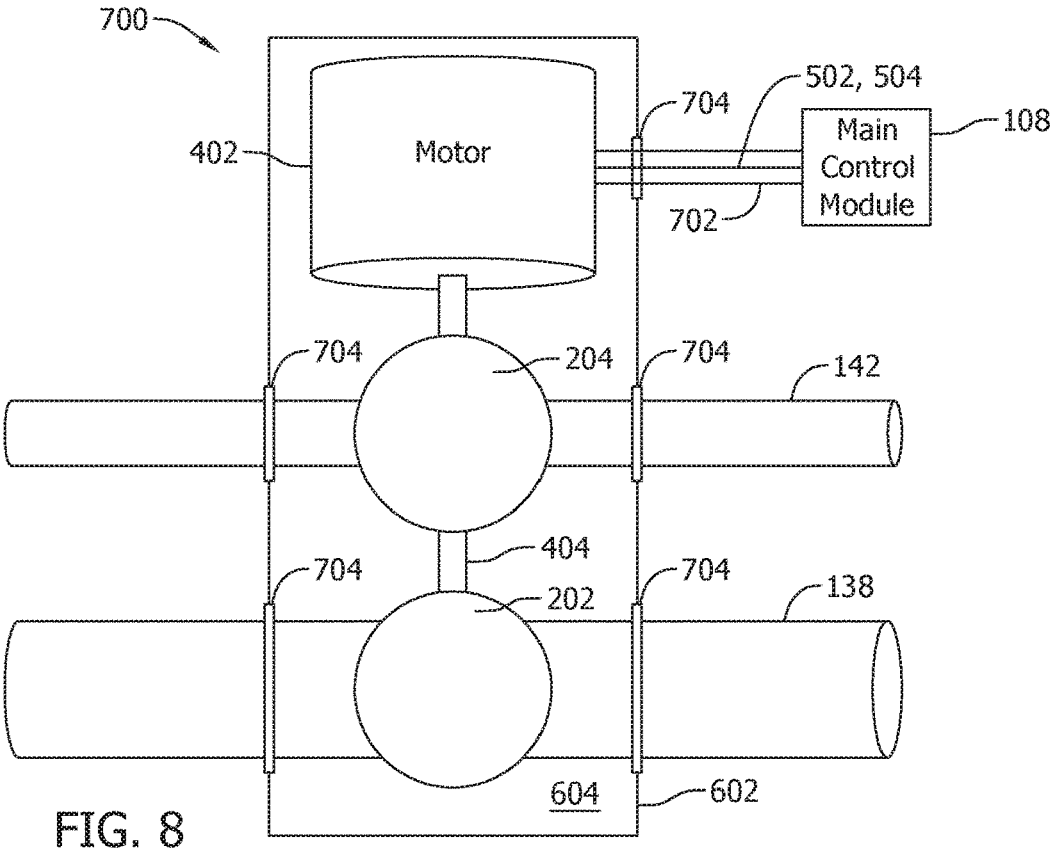
FIG. 8 is an alternative schematic of the valve operation system shown in FIG. 7 used in conjunction with the HVAC system shown in FIG. 1.

FIG. 7 is a schematic view of an example alternative valve operation system 700. FIG. 8 is a schematic view of alternative valve operation system 700 used in conjunction with HVAC system 100. Like valve operation system 600, valve operation system 700 includes enclosure 602 surrounding valves 202, 204. In valve operation system 700, motor 402 is also contained within cavity 604 of enclosure 602. In some embodiments, motor wire 502 and sensor wire 504 are at least partially encased within a water-resistant material 702, preventing contact with any fluid that leaks from valves 202, 204. In further embodiments, water-resistant material 702 hermetically seals motor wire 502 and sensor wire 504. In some embodiments, water-resistant material 702 extends through sealing body 606 within a wall of enclosure 602. In further embodiments, a line sealing body 704 extends along a wall of enclosure 602 and water-resistant material 702 extends through line sealing body. Accordingly, in some embodiments, line sealing body 704 helps isolate cavity 604 from outside are 101 and prevents leakage of fluid out of cavity 604 along water-resistant material 702. In some embodiments, line sealing body 704 includes a rubber or polymer ring.

As shown in FIG. 8, in some embodiments of valve operation system 700, suction line 138 extends into and out of cavity 604 through line sealing bodies 704 within the walls of enclosure 602, allowing suction line 138 to fluidly connect with suction-line valve 202. Similarly, liquid line 142 extends into and out of cavity 604 through line sealing bodies 704 within the walls of enclosure 602, allowing liquid line 142 to fluidly connect with liquid-line valve 204. In some embodiments, a similar configuration allows for connection of suction line 138 and liquid line 142 to valve operation system 600.

Figure 9:
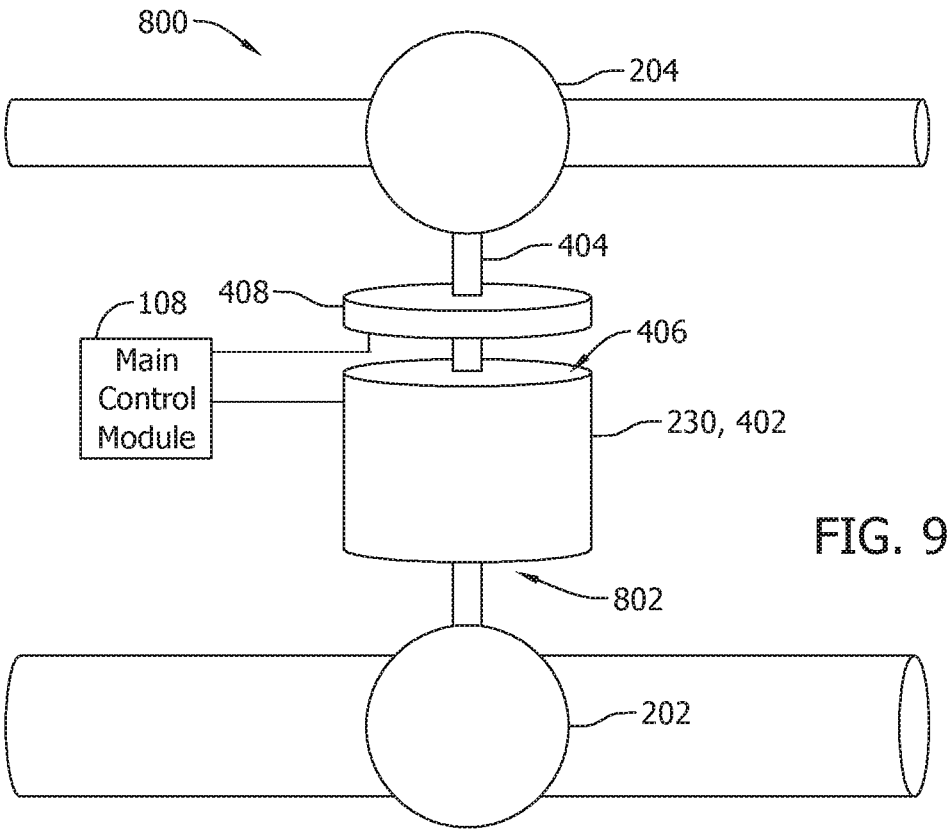
FIG. 9 is a schematic of an alternative valve operation system for use with the HVAC system shown in FIG. 1.

It will be appreciated that the configuration of valves 202, 204, motor 402, and shaft 404 shown in valve operation systems 500, 600, 700 are provided for illustrative purposes and that other configurations are contemplated within the scope of this disclosure. For example, as illustrated by valve operation system 800 in FIG. 9, in some configurations, motor 402 is located between suction-line valve 202 and liquid-line valve 204 and shaft 404 extends from first end 406 to liquid-line valve 204 and from a second end 802 to suction-line valve 202. Additionally, like systems 600 and 700, valve operation system 800 may include one or more enclosures 602 (shown in FIGS. 6 and 7), isolating valves 202, 204 and/or motor 402 from outside area 101.

Figure 10:
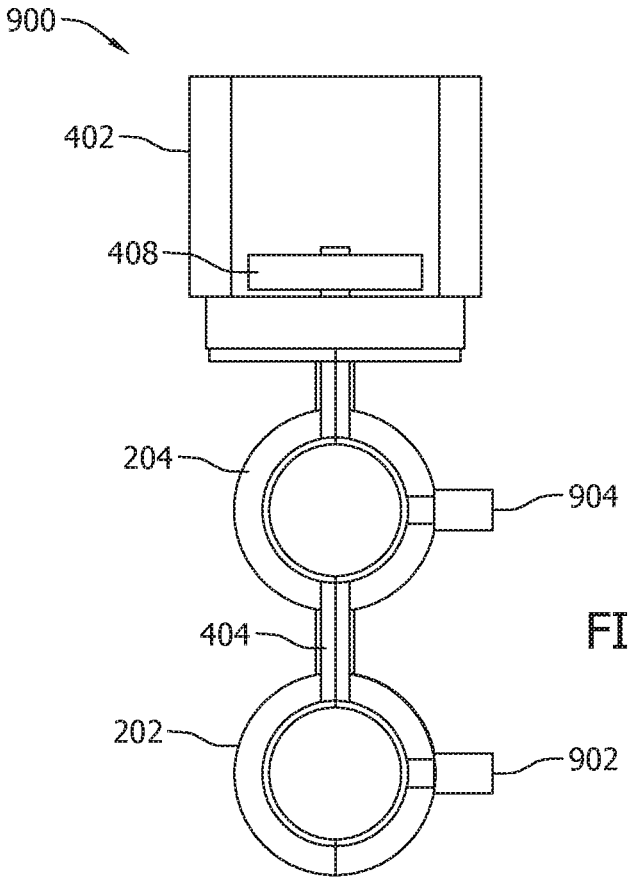
FIG. 10 is a schematic view of a valve system configuration having dedicated service valves for use with the HVAC system shown in FIG. 1.

FIG. 10 is a schematic view of an alternative valve configuration 900 having dedicated service valves. Valve configuration 900 includes a suction-line service valve 902 coupled to suction-line valve 202 and a liquid-line service valve 904 coupled to liquid-line valve 204. In an embodiment, service valves 902, 904 are Schrader valves. In alterative embodiments, service valves 902, 904 are any valves that allow valve configuration 900 to operate as described herein.

Valve configuration 900 is configured to perform rotation sequence 300 and pump down refrigerant 136 from structure 102 at the end of each cooling cycle. Specifically, the pump down process (i.e. the transition from fourth position 308 to first position 302) causes refrigerant 136 to be isolated within condensing unit 178 between suction-line valve 202 and liquid-line valve 204. If, during a service process, a technician desires to monitor pressures or remove or replace refrigerant, valves 902, 904 may be used to access refrigerant 136 isolated within condensing unit 178. It will be appreciated that one or both valves 902, 904 may be used to access refrigerant 136. It will also be appreciated that suction-line valve 202 and/or liquid-line service valve 904 may be placed in other positions within HVAC system that allow access to refrigerant while stored in condensing unit 178.

Embodiments of the cooling systems described help reduce and/or mitigate potential risks associated with the flammability of certain refrigerants by pumping down the refrigerant within the cooling system from an interior space to an exterior module between each cycle of the cooling system. Accordingly, the cooling systems described allow for the use of at least mildly flammable refrigerants and thus provide the ability to replace refrigerants with high GWP with refrigerants with lower GWP, reducing the potential environmental impacts of the cooling systems. Further, actuation of valves within the cooling systems allows for refrigerant stored in a condensing unit to flow into a structure in a controlled manner, preventing flooded start conditions and reducing or alleviating the need for the compressor to start under pressure. In some embodiments, the traditional service valves are replaced altogether, reducing the overall cost associated with adding the pump down functionality to the HVAC system.

It will be appreciated that the above embodiments that have been described in particular detail are merely example or possible embodiments, and that there are many other combinations, additions, or alternatives that may be included.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. A valve system comprising:

a motor having a shaft;

a first valve connected to the shaft, the first valve rotatable to an open position, in which fluid flows through a first channel, and a close position, in which fluid is prevented from flowing through the first channel;

a second valve connected to the shaft, the second valve rotatable to an open position, in which fluid flows through a second channel, and to a close position, in which fluid is prevented from flowing through the second channel; and a controller connected to the motor, the controller configured to, using the motor and the shaft, sequentially actuate the first valve and the second valve to create at least (i) a first position, in which the first valve is in the closed position and the second valve is in the closed position, (ii) a second position, in which the first valve is in the open position, (iii) a third position, in which the first valve is in the open position and the second valve is in the open position, and (iv) fourth position, in which the first valve is in a closed position and the second valve is in the open position.

2. The valve system of claim 1, wherein the first valve includes a first ball valve having a first body and a first ball, the first ball having a first end, an opposing second end, and the first channel therethrough.

3. The valve system of claim 2, wherein the second valve includes a second ball valve having a second body and a second ball, the second ball having a first end, an opposing second end, and the second channel therethrough.

4. The valve system of claim 1 further comprising an enclosure having a cavity, wherein the first valve and the second valve are contained within the cavity, the cavity configured to contain fluid leaked from the first valve and the second valve within the cavity.

5. The valve system of claim 4, wherein a portion of the shaft extends through the enclosure into the cavity.

6. The valve system of claim 4, wherein the motor and the shaft are contained within the cavity.

7. The valve system of claim 6, wherein a connecting wire extends from the motor to the controller, wherein the connecting wire is encased in a water-resistant material, and wherein the water-resistant material extends from inside the cavity to the controller outside of the enclosure.

8. The valve system of claim 1, wherein, in the second position, the second valve is closed.

9. The valve system of claim 1, wherein the shaft extends from a first end of the motor, and wherein the first valve and second valve are connected sequentially along the shaft.

10. The valve system of claim 1, wherein the first channel has a first centerline and the second channel has a second centerline, and wherein the second centerline is angularly offset relative to the first centerline.

11. A cooling system comprising:

an air handling unit configured to distribute air, the air handling unit comprising an evaporator;

a condensing unit comprising a compressor and a condenser, the compressor fluidly connected to the condenser by a compressor discharge line configured to channel refrigerant from the compressor to the condenser;

a suction line configured to channel refrigerant from the evaporator to the compressor;

a liquid line configured to channel refrigerant from the condenser to the evaporator; and a valve system comprising:

a motor having a shaft;

a liquid-line valve connected to the shaft and in fluid communication with the liquid line, the liquid-line valve including a liquid-line channel therethrough, the liquid-line valve rotatable to an open position, in which refrigerant flows through the liquid-line channel, and to a closed position, in which refrigerant is prevented from flowing through the liquid-line channel;

a suction-line valve connected to the shaft and in fluid communication with the suction line, suction-line valve including a suction-line channel therethrough, the suction-line valve rotatable to an open position, in which refrigerant flows, using suction, through the suction-line channel, and to a close position, in which refrigerant is prevented from flowing through the suction-line channel; and a controller connected to the motor, the controller configured to, using the motor and the shaft, sequentially actuate the liquid-line valve and the suction-line valve to create at least (i) a first position, in which the liquid-line valve is in the closed position and the suction-line valve is in the closed position, (ii) a second position, in which the liquid-line valve is in the open position, (iii) a third position, in which the liquid-line valve is in the open position and the suction-line valve is in the open position, and (iv) fourth position, in which the liquid-line valve is in a closed position and the suction-line valve is in the open position.

12. The cooling system of claim 11, wherein the liquid-line valve includes a ball valve having a liquid-line valve body and a liquid-line valve ball, the liquid-line valve ball having a first end, an opposing second end, and the liquid-line channel therethrough.

13. The cooling system of claim 11, wherein the suction-line valve includes a ball valve having a suction-line valve body and a suction-line valve ball, the suction-line valve ball having a first end, an opposing second end, and the suction-line channel therethrough.

14. The cooling system of claim 11, wherein substantially all of the refrigerant is contained upstream of the suction-line valve and downstream of the liquid-line valve when the valve system is in the first position.

15. The cooling system of claim 11, wherein, when the valve system is in the third position, the compressor is configured to pump down most of the refrigerant upstream of the liquid-line valve and downstream of the suction-line valve.

16. The cooling system of claim 11 further comprising an enclosure having a cavity, wherein the liquid-line valve and the suction-line valve are contained within the cavity, the cavity configured to contain any leaked fluid from the liquid-line valve and the suction-line valve within the cavity.

17. The cooling system of claim 16, wherein the suction line and the liquid line extend through the enclosure and into the cavity to fluidly connect the suction-line valve and the liquid-line valve, respectively, to the cooling system.

18. The cooling system of claim 11, wherein valve system further comprises a position sensor is operatively coupled to the shaft, the position sensor configured to detect the position of the shaft during operation of the motor.

19. The cooling system of claim 11, wherein the liquid-line channel has a first centerline and the suction-line channel has a second centerline, and wherein the second centerline is angularly offset relative to the first centerline.

20. The cooling system of claim 11, wherein at least one of the suction-line valve and the liquid-line valve includes a Schrader-type service valve.

* * * * *